US007996971B2

(12) United States Patent
Newton

(10) Patent No.: US 7,996,971 B2
(45) Date of Patent: Aug. 16, 2011

(54) SEAL REMOVAL APPARATUS

(75) Inventor: Michael M. Newton, Dardenne Prairie, MO (US)

(73) Assignee: The Boeing Company, Chicago, IL (US)

( * ) Notice: Subject to any disclaimer, the term of this patent is extended or adjusted under 35 U.S.C. 154(b) by 993 days.

(21) Appl. No.: 11/861,820

(22) Filed: Sep. 26, 2007

(65) Prior Publication Data

US 2009/0078089 A1 Mar. 26, 2009

(51) Int. Cl.
*B24P 11/00* (2006.01)

(52) U.S. Cl. ..... 29/243.55; 254/21; 254/131; 269/3; 81/3.09

(58) Field of Classification Search ..... 269/3, 6; 254/21–25, 131, 131.5; 29/270–278, 242–243, 29/426.1, 426.5; 81/3.09, 3.55, 3.57
See application file for complete search history.

(56) References Cited

U.S. PATENT DOCUMENTS 110,127 A * 12/1870 Felter ..... 81/3.44
919,370 A * 4/1909 Lund ..... 254/22
1,363,515 A * 12/1920 Knoss, Jr. ..... 81/3.8
1,377,178 A * 5/1921 Andree ..... 81/98
1,724,722 A * 8/1929 Plack ..... 81/3.56
1,897,991 A * 2/1933 Arnof ..... 7/126
2,103,008 A * 12/1937 Kinast ..... 254/21
2,471,557 A * 5/1949 Bishop ..... 81/8.1
3,029,503 A * 4/1962 Meyer ..... 29/283
3,755,875 A * 9/1973 Staab ..... 29/240
4,211,446 A * 7/1980 Shultz, Sr. ..... 294/26
4,649,618 A * 3/1987 Harrison ..... 29/426.5
5,031,485 A * 7/1991 Wu ..... 81/3.44
5,161,435 A * 11/1992 Brannon ..... 81/3.09
5,611,519 A * 3/1997 Garcia ..... 254/22
6,779,239 B2 * 8/2004 Kefalas et al. ..... 29/402.01
6,880,217 B2 * 4/2005 Garst ..... 29/235
7,025,331 B2 * 4/2006 Whelan ..... 254/25
7,039,993 B1 * 5/2006 Smith et al. ..... 29/235
7,040,195 B1 * 5/2006 Lackey et al. ..... 81/45

* cited by examiner

*Primary Examiner* — George Nguyen
(74) *Attorney, Agent, or Firm* — Klintworth & Rozenblat IP LLC

(57) ABSTRACT

One embodiment of a seal removal tool may include a handle, a seal grasping member, and a biasing member. The handle may have an end with a curved surface to roll back a seal. The seal grasping member may be adapted to move from an open extended position into a closed position in order to grasp and secure a seal. The biasing member may bias the seal grasping member towards the closed position.

34 Claims, 5 Drawing Sheets

SEAL REMOVAL APPARATUS

STATEMENT OF GOVERNMENT RIGHTS

This invention was made with Government support. The government has certain rights in this invention.

BACKGROUND

Seals are often used to seal structures, such as scaling an aircraft door to a door frame. It is sometimes necessary to remove one or more portions of the seal to conduct maintenance. One of the existing methods to remove a seal is for a maintenance user to roll back the seal from the door and/or doorframe using only his or her fingers. However, this may be straining to the user, may be timely which may lead to increased costs, may be difficult, may damage the seals or the adhesive holding the seals, and/or may lead to other types of problems.

A seal removing device and/or method of removing a seal is needed to decrease one or more problems of one or more of the existing devices and/or methods.

SUMMARY

In one aspect of the disclosure, a seal removal tool comprises a handle and a seal grasping member. The seal grasping member is adapted to move from a first position not secured to a seal to a second position secured to a seal.

In another aspect of the disclosure, a method for removing a seal is disclosed. In one step, a seal removal tool is provided comprising a handle and a seal grasping member. In another step, the seal grasping member is moved into a first position adjacent to but not secured to the seal. In still another step, the seal grasping member is moved into a second position secured to the seal. In yet another step, the handle is rotated to remove the seal.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 3:
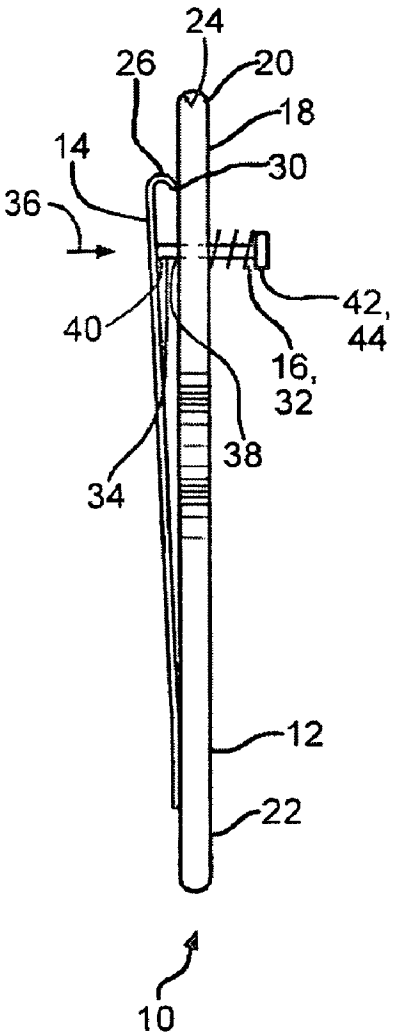
FIG. 3 shows a side view of the embodiment of the seal removal tool of FIG. 1 in second closed position.
Figure 2:
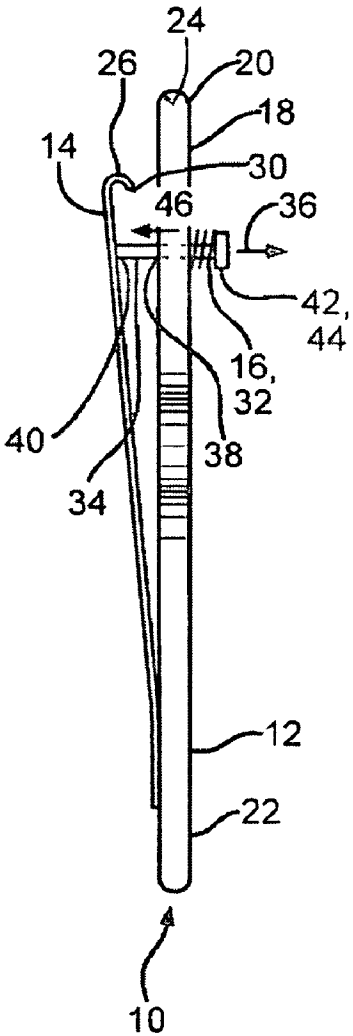
FIG. 2 shows a side view of the embodiment of the seal removal tool of FIG. 1 in a first extended position.
Figure 1:
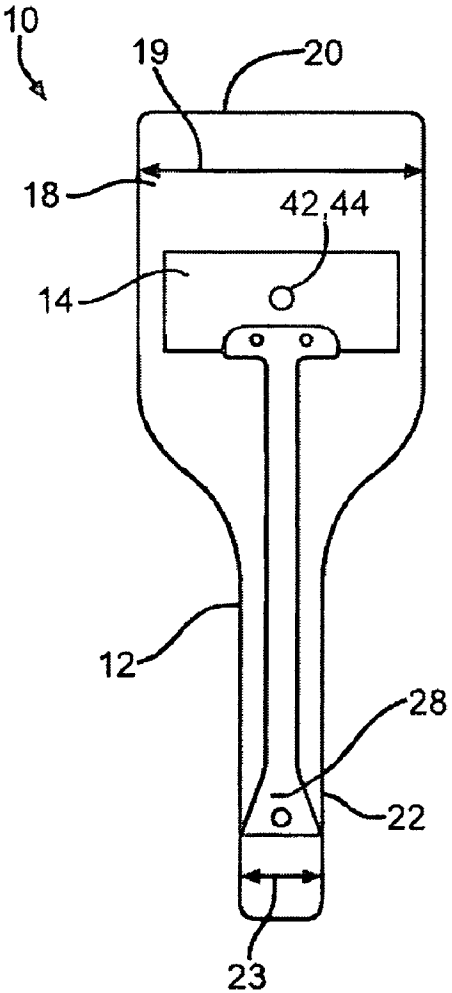
FIG. 1 shows a top view of one embodiment of a seal removal tool under the disclosure.

FIG. 1 shows a top view of one embodiment of a seal removal tool 10. FIGS. 2 and 3 respectively show side views of the embodiment of the removal tool 10 of FIG. 1 in a first extended position (FIG. 2) and in a second closed position (FIG. 3). The seal removal tool 10 may comprise a handle 12, a seal grasping member 14, and a biasing member 16. The removal tool 10 may be used to remove a seal of a vehicle, of an aircraft, or of another type of structure. In one embodiment, the removal tool 10 may be used to remove a seal of an aircraft door to access an aircraft door frame fastener. In another embodiment, the tool 10 may be used to remove varying types of seals or other types of structures.

The handle 12 may comprise a first end 18 with a curved surface 20, and a second end 22 which may be gripped and rotated by a user of the tool 10. The first end 18 of the handle 12 may have a width 19 which is wider than a width 23 of the second end 22 of the handle 12. The curved surface 20 of the first end 18 of the handle 12 may be used for contacting and rolling back a seal. The curved surface 20 may have a radius 24 in the range of 1/16 of an inch to 1 inch. In other embodiments, the surface 20 and the first and second ends 18 and 22 of the handle 12 may be of varying shapes, sizes, orientations, and configurations, in order to allow for handling of the handle 12 and to allow for contact with a seal.

The seal grasping member 14 may comprise a flexible hook 26 which may be adapted to change positions from the first, extended position of FIG. 2 to the second, closed position of FIG. 3. One end 28 of the hook 26 may be attached to the second end 22 of the handle 12 through welding or another attachment mechanism. Another end 30 of the hook 26 may not be attached to the handle 12 in order to allow the hook 26 to be flexible so that it may move from the first, extended position of FIG. 2 to the second, closed position of FIG. 3.

The biasing member 16 may be adapted to bias the seal grasping member 14 towards the second, closed position of FIG. 3. The biasing member 16 may comprise a spring 32. The spring 32 may bias a moveable bolt 34 towards direction 36. The bolt 34 may be movably disposed through a hole 38 in the handle 12 substantially perpendicular to the handle 12. One end 40 of the bolt 34 may be attached to the flexible seal grasping member 14. Another end 42 of the bolt 34 may terminate in a cap 44. In another embodiment, the seal grasping member 14 may be utilized without the biasing member 16. In still another embodiment, end 40 of the bolt 34 may be in contact with the flexible seal grasping member 14 without being attached to it.

As shown in FIG. 2, the cap 44 of the bolt 34 may be pressed in direction 46 towards the handle 12 by a user to force the spring 32 to compress between the cap 44 and the handle 12 in order to force the bolt 34 to also move in direction 46 by sliding within hole 38. This movement of the bolt 34 may cause the attached flexible seal grasping member to also move in direction 46 in order to dispose the seal grasping member 14 in the first, extended position away from the handle 12.

As shown in FIG. 3, the cap 44 of the bolt 34 may be depressed (or released) by a user so that the biasing member 16 forces the cap 44, bolt 34, and seal grasping member 14 to move in direction 36 so that the seal grasping member 14 is disposed into the second, closed position closer to the handle 12 than in the first, extended position. In such manner, by a user pressing (FIG. 2) and depressing (FIG. 3) the cap 44, the seal grasping member 14 may be adapted to change positions from the first extended position of FIG. 2 to the second, closed position of FIG. 3.

Figure 4:
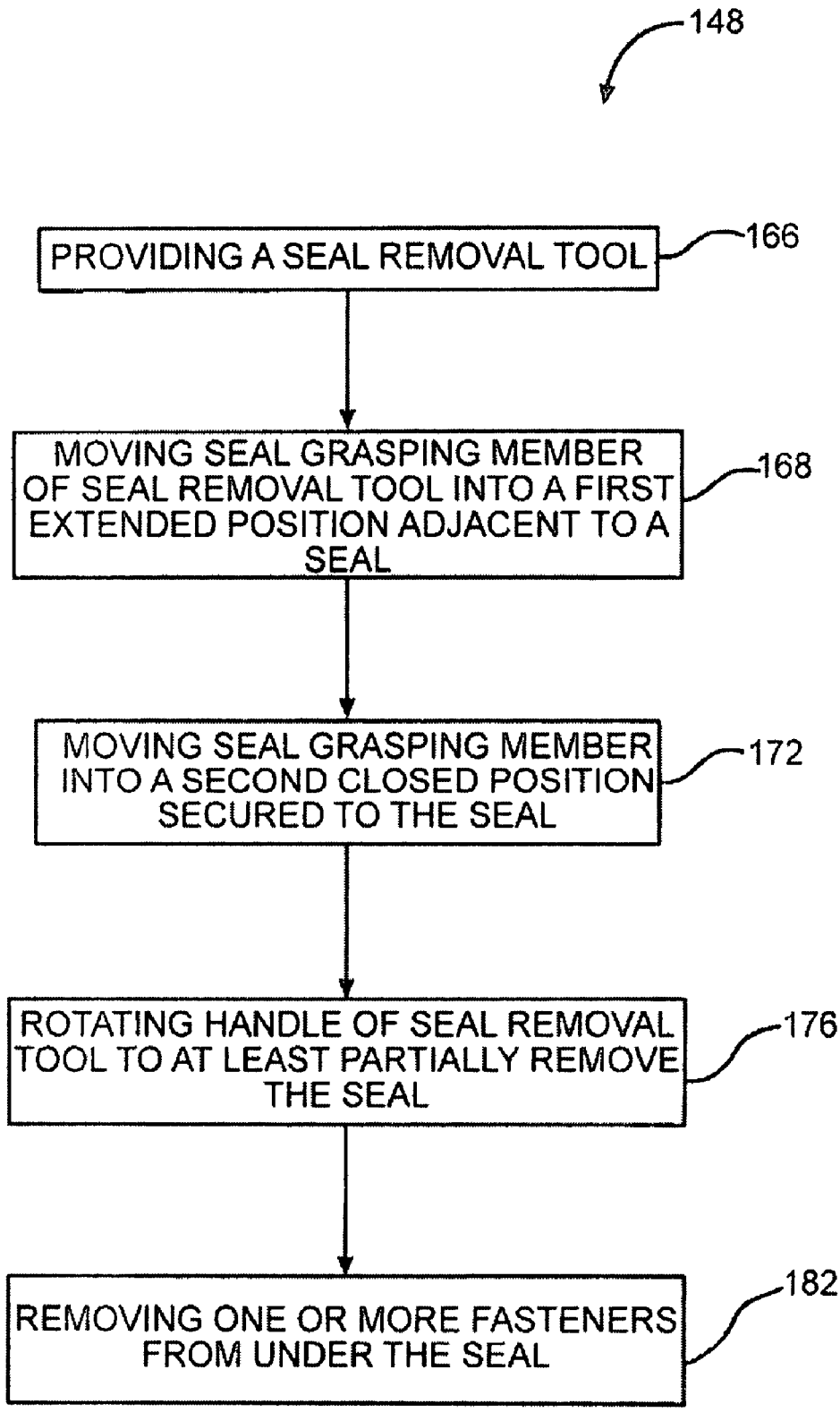
FIG. 4 shows a flowchart of one embodiment of a method under the disclosure for removing a seal.
Figure 5:
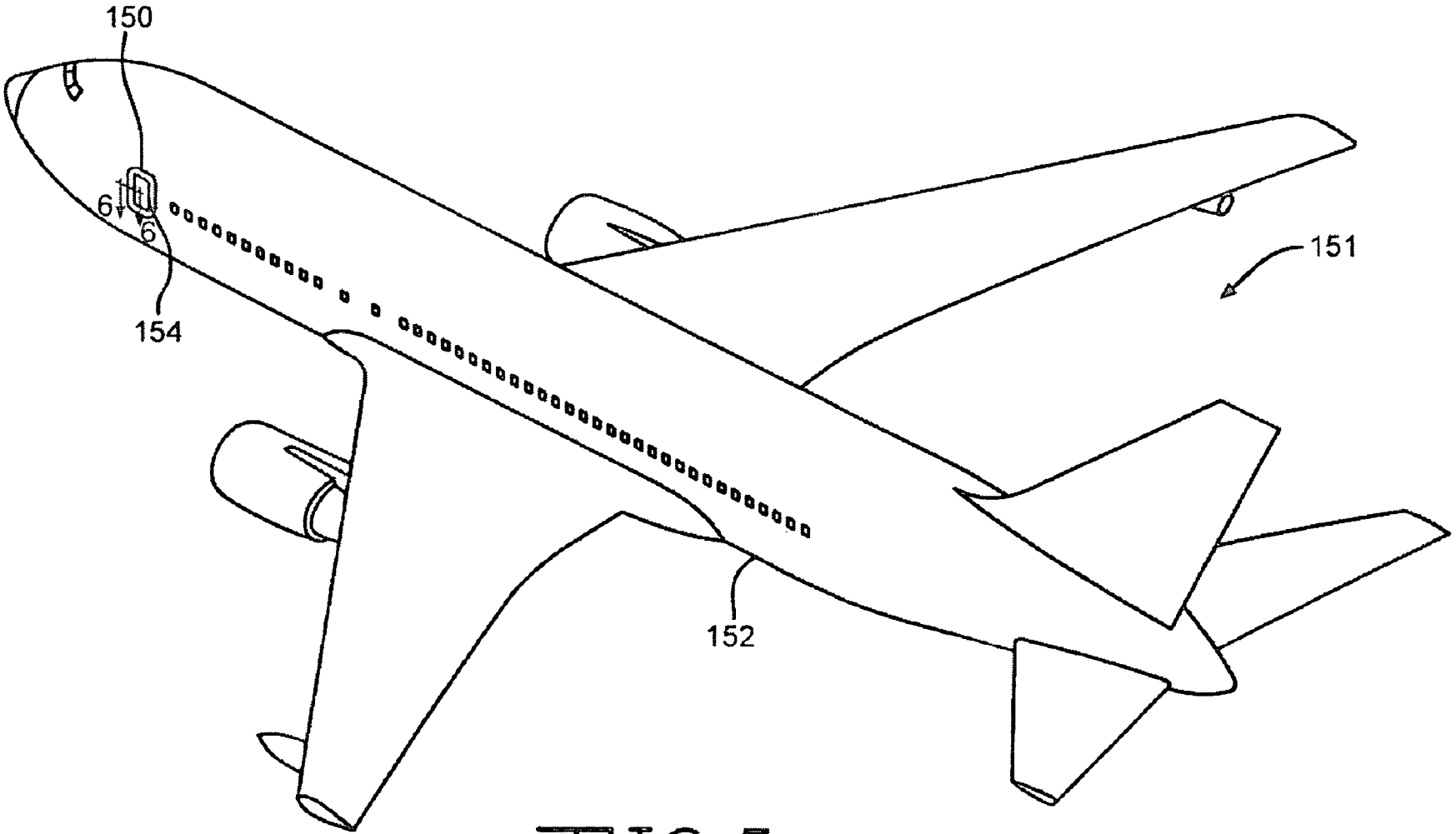
FIG. 5 shows a perspective view of one embodiment of an aircraft having a door seal which may be removed utilizing the disclosure.
Figure 6:
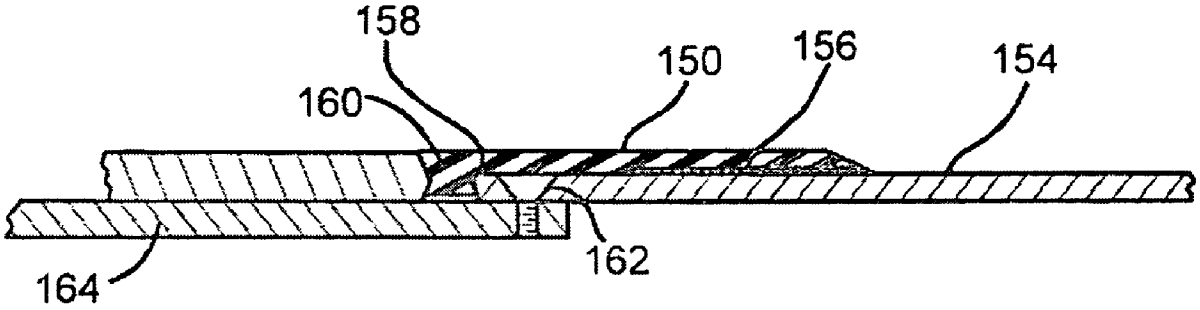
FIG. 6 shows a partial cross-sectional view through line 6-6 of the embodiment of FIG. 5.

FIG. 4 shows a flowchart of one embodiment of a method 148 for removing a seal 150. As shown in FIG. 5, which shows a perspective view of a vehicle 151 in the form of an aircraft 152, the seal 150, which may be removed using the method of FIG. 4, may be part of a vehicle 150 or part of another type of structure. The seal 150 may be attached to the periphery of an aircraft door 154, as shown in FIG. 5, and as better shown in FIG. 6, which shows a partial cross-section view through line 6-6 of the embodiment of FIG. 5. The seal 150 may be glued to the door 154 at locations 156 along the door 154 and seal 150. The seal 150 may include an inner, angled surface 158 at one end 160 of the seal 150. The seal 150 may cover one or more fasteners 162 which fasten the door 154 to a door frame 164. The fasteners 162 may comprise bolts or other fastening mechanism.

In step 166 of the method 148 of FIG. 4, a seal removal tool 10 is provided. The seal removal tool 10 may comprise any of the embodiments disclosed herein. In one embodiment, the seal removal tool 10 may comprise a handle 12 and a seal grasping member 14. The handle 12 may comprise a first end 18 having a curved surface 20 and a second end 22. The seal grasping member 14 may comprise a hook 26. A moveable bolt 34 may be attached to the seal grasping member 14 and may extend through a hole 38 in the handle 12. The bolt 34 may be disposed substantially perpendicular to the handle 12.

Figure 7:
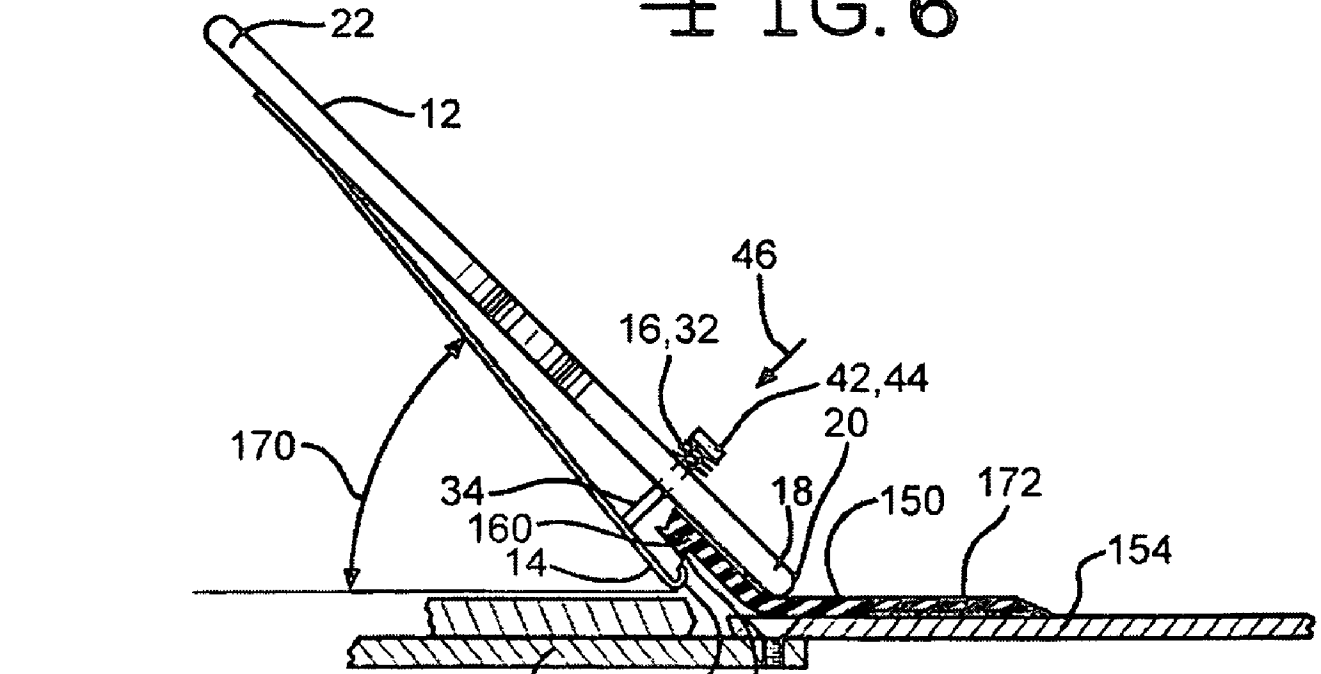
FIG. 7 shows a side view of the embodiment of the seal removal tool of FIG. 1 in a first extended position adjacent but not secured to a seal.

In step 168 of the method 148 of FIG. 4, the seal grasping member 14 may be moved into a first, extended position, as shown in FIG. 2, adjacent to but not secured to the seal 150. This is shown in FIG. 7, which is a side view of the seal grasping member 14 in the first extended position adjacent to but not secured to the seal 150. The seal grasping member 14 may be put in the first extended position by a user pushing a cap 44 of the bolt 34 towards the handle 12, with the bolt 34 forcing the seal grasping member 14 into the first extended position. The extended position of the seal grasping member 14 away from the handle 12 may allow the tool 10 to be aligned so that end 160 of the seal 150 is disposed between the first end 18 of the handle 12 and the seal grasping member 14. In order to obtain this alignment, the handle 12 may be disposed at a first angle 170 relative to a sealed portion 172 of the seal 150 against the door 154. The first angle 170 may substantially be in a range of 0 to 45 degrees.

Figure 8:
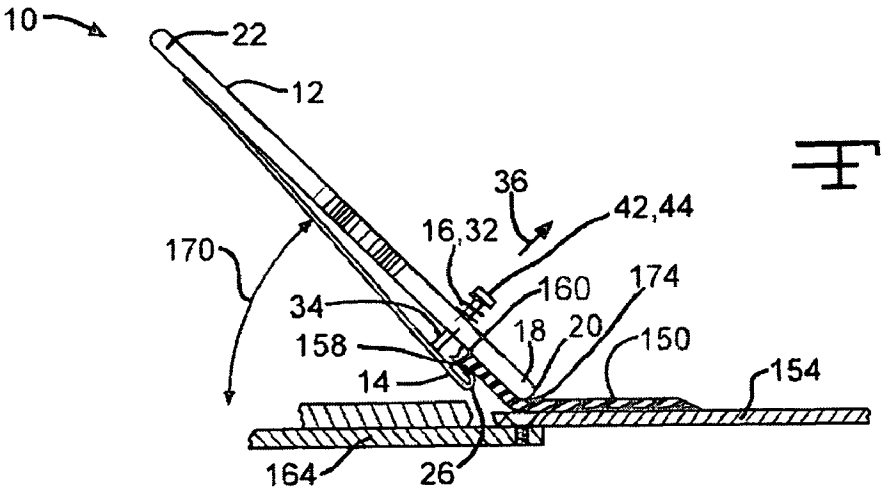
FIG. 8 shows a side view of the embodiment of the seal removal tool of FIG. 1 in a second closed position secured to a seal.

In step 172 of the method 148 of FIG. 4, the seal grasping member 14 may be moved towards and/or into a second closed position, as shown in FIG. 3, secured to the seal 150. This is shown in FIG. 8, which is a side view of the seal grasping member 14 in the second closed position secured to the seal 150. The seal grasping member 14 may be put into the second closed position by the user releasing (or depressing) the cap 44 of the bolt 34 allowing the biasing member 16, which may comprise a spring 32, to force the cap 44, bolt 34, and attached seal grasping member 14 to move in direction 36. When this occurs, the hook 26 of the seal grasping member 14 may latch onto the inner, angled surface 158 of the seal 150. The seal grasping member 14 and hook 26 may collapse towards the handle 12 to secure the end 160 of the seal 150 between the seal grasping member 14 and the handle 12 in the second closed position. The curved surface 20 of the first end 18 of the handle 12 may abut against a portion 174 of the seal 150. The first angle 170 may remain substantially between 0 and 45 degrees.

Figure 9:
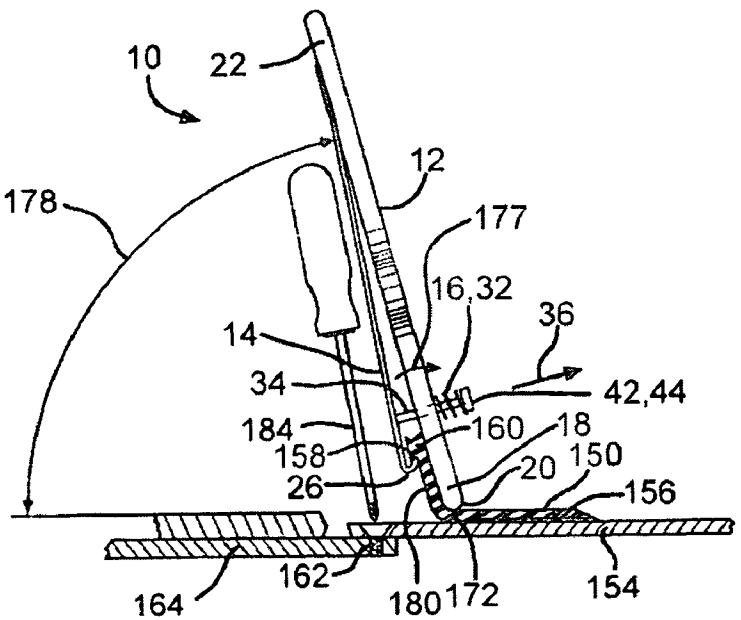
FIG. 9 shows a side view of the embodiment of the seal removal tool of FIG. 8 after it has been rotated to partially remove the seal to allow a fastener to be removed.

In step 176, the handle 12 may be rotated by a user in direction 177 from its position of FIG. 8 to its position of FIG. 9 to at least partially remove and/or roll back the seal 150 from the door 154. The curved surface 20 of the first end 18 of the handle 12 may facilitate the rolling back of the seal 150. During this rotation process, the user may grip and rotate the second end 22 of the handle 12. The handle 12 may be rotated from the first angle 170 of FIGS. 7 and 8 to a second angle 178 of FIG. 9 of substantially 90 degrees in which the handle 12 is substantially perpendicular to the sealed portion 172 of the seal 150. In other embodiments, the first and second angles 170 and 178 may vary. During the rolling back process, the glue at locations 156 between the door 154 and the seal 150 may substantially remain in place, and the portion 180 of the seal 150 which is rolled back may not have been glued to the door 154 and/or to the door frame 164.

In step 182, as shown in FIG. 9, after the portion 180 of the seal 150 is rolled back, one or more fasteners 162 may be removed from under the seal 150. The removed fasteners 162 may comprise bolts connecting the door 154 to the door frame 164. The fasteners 162 may be removed using a screwdriver 184 or other removal device.

This disclosure may reduce one or more problems of one or more of the existing seal removal tools and/or methods for removing a seal. For instance, the disclosure may make it less timely, less difficult, less costly, and/or may allow for less seal damage and/or less user injury than one or more of the existing tools and/or methods of removal.

It should be understood, of course, that the foregoing relates to exemplary embodiments of the disclosure and that modifications may be made without departing from the spirit and scope of the disclosure as set forth in the following claims.

The invention claimed is:

1. A seal removal tool comprising:

a handle; and a seal grasping member moveably attached to the handle configured to move from a first position relative to the handle to a second position farther away from the handle;

a moveable member fixedly attached to the seal grasping member and moveably disposed relative to the handle; and a biasing member disposed against the moveable member biasing the seal grasping member in a direction relative to the handle.

2. The seal removal tool of claim 1 wherein the moveable member moveably extends through a hole in the handle.

3. The seal removal tool of claim 1 wherein the moveable member comprises a bolt and the biasing member is disposed against a cap of the bolt.

4. The seal removal tool of claim 1 wherein the handle comprises a curved surface at a first end of the handle for rolling back a seal.

5. The seal removal tool of claim 4 wherein the curved surface comprises a semi-circle having a radius in a range of 1/16 of an inch to 1 inch.

6. The seal removal tool of claim 4 wherein the handle has a second end for being grasped and rotated by a user to roll back the seal.

7. The seal removal tool of claim 1 wherein the seal grasping member comprises a hook.

8. The seal removal tool of claim 7 wherein the hook is angled inwardly towards a linear portion of the seal grasping member from which the hook extends.

9. The seal removal tool of claim 1 wherein a first end of the handle extends over and beyond an end of the seal grasping member.

10. The seal removal tool of claim 1 wherein the biasing member comprises a spring.

11. The seal removal tool of claim 1 wherein the biasing member extends between the handle and the moveable member.

12. The seal removal tool of claim 1 wherein the biasing member biases the seal grasping member towards the first position.

13. The seal removal tool of claim 1 wherein one end of the seal grasping member is welded to handle.

14. The seal removal tool of claim 1 wherein the moveable member is disposed substantially perpendicular to the handle.

15. The seal removal tool of claim 6 wherein during removal of the seal the handle is rotated from a first angle relative to a sealed portion of the seal in a range of 0 to 45 degrees to a second angle in which the handle is substantially perpendicular to the sealed portion of the seal.

16. The seal removal tool of claim 1 wherein during removal of a seal the seal grasping member is configured to allow the seal to be slipped between the seal grasping member and the handle when the seal grasping member is disposed in the second position.

17. The seal removal tool of claim 1 wherein during removal of a seal the seal grasping member is configured to hold the seal between the seal grasping member and the handle when the seal grasping member is disposed in the first position.

18. A method for removing a seal comprising:

providing a seal removal tool comprising a handle, a seal grasping member moveably attached to the handle, a moveable member fixedly attached to the seal grasping member and moveably disposed relative to the handle, and a biasing member disposed against the moveable member biasing the seal grasping member in a direction relative to the handle;

disposing the seal removal tool, with the seal grasping member disposed in a position relative to the handle, so that a seal is disposed between the handle and the seal grasping member; and moving the seal grasping member to another position closer to the handle to secure the seal between the handle and the seal grasping member.

19. The method of claim 18 wherein the moveable member is moveably extended through a hole in the handle.

20. The method of claim 18 wherein the moveable member comprises a bolt and the biasing member is disposed against a cap of the bolt.

21. The method of claim 18 wherein the handle comprises a curved surface at a first end of the handle, and further comprising disposing the curved surface of the handle against the seal.

22. The method of claim 21 wherein the curved surface comprises a semi-circle having a radius in a range of 1/16 of an inch to 1 inch.

23. The method of claim 21 wherein the handle has a second end, and further comprising rotating the second end to roll back the seal.

24. The method of claim 18 wherein the seal grasping member comprises a hook.

25. The method of claim 24 wherein the hook is angled inwardly towards a linear portion of the seal grasping member from which the hook extends.

26. The method of claim 18 wherein a first end of the handle extends over and beyond an end of the seal grasping member.

27. The method of claim 18 wherein the biasing member comprises a spring.

28. The method of claim 18 wherein the biasing member extends between the handle and the moveable member.

29. The method of claim 18 wherein the biasing member biases the seal grasping member towards the closer position, and further comprising a user pushing the moveable member towards the handle during the disposing step to move the seal grasping member into the position, and the user releasing the moveable member during the moving step so that the biasing member moves the seal grasping member towards the closer position.

30. The method of claim 18 wherein one end of the seal grasping member is welded to the handle.

31. The method of claim 18 wherein the moveable member is disposed substantially perpendicular to the handle.

32. The method of claim 23 wherein the handle is rotated from a first angle relative to a sealed portion of the seal in a range of 0 to 45 degrees to a second angle in which the handle is substantially perpendicular to the sealed portion of the seal.

33. The method of claim 18 wherein the seal is attached to an aircraft door.

34. The method of claim 18 further comprising rotating the handle to remove the seal and removing a fastener disposed under the seal.

* * * * *